United States Patent [19]

Potter

[11] 3,992,815

[45] Nov. 23, 1976

[54] WINDOW SASH AND FRAME

[76] Inventor: William W. Potter, 1718 College Ave., SE., Grand Rapids, Mich. 49507

[22] Filed: Feb. 27, 1975

[21] Appl. No.: 553,461

[52] U.S. Cl. ..... 49/62; 49/449; 52/202; 292/263

[51] Int. Cl.[2] ..... E05C 7/02

[58] Field of Search ..... 49/61, 62, 463, 465, 49/450, 449, 501, 504; 52/202; 292/262; 160/90, 91

[56] References Cited

UNITED STATES PATENTS

| | | | |
|---|---|---|---|
| 2,246,075 | 6/1941 | Phillips et al. | 52/202 X |
| 3,754,783 | 8/1973 | Childers | 49/449 X |
| 3,808,742 | 5/1974 | Ehret et al. | 49/413 |

FOREIGN PATENTS OR APPLICATIONS

| | | | |
|---|---|---|---|
| 976,878 | 12/1964 | United Kingdom | 49/425 |

*Primary Examiner*—Kenneth Downey
*Attorney, Agent, or Firm*—Price, Heneveld, Huizenga & Cooper

[57] ABSTRACT

An extruded frame member for a window integrally includes guide channels for slidably receiving a window, an outwardly projecting drip cap and an outwardly projecting arm having an enlarged rounded end extending along the exterior of the frame member spaced inwardly from the drip cap. A window so formed provides the entire structure required for installing complete window units of any desired dimensions and for attaching storm windows or screens to such a window unit. The extruded frame member further includes means for locking conventional sliding or double and single hung windows slidably fitted in the frame.

9 Claims, 5 Drawing Figures

WINDOW SASH AND FRAME

BACKGROUND OF THE INVENTION

The present invention relates to sliding closures and particularly to window constructions.

In window units, a variety of framing and trim structures have been employed for framing a rough hole into which a window is to be fitted. Typically, when the window includes sliding sashes for opening and closing the windows, additional separate channel members are provided. Such complex structures typically are separate extrusions of aluminum, bolted together to complete the window unit.

SUMMARY OF THE INVENTION

The above shortcomings of the prior art have been overcome by the improved construction of the present invention which employs an integrally extruded frame and connector for receiving storm glass or screen units including an extruded sash having a mating connector for attachment to the frame. The frame includes channel means for receiving sliding closure members of the unit and is configurated for mounting directly to an opening formed in the wall of the building in which the unit is attached. Locking means is provided for the frame which restricts the channel and prevents movement of a sliding window or door and promotes runoff of water.

It is an object, therefore, of the present invention to provide an improved integral window or door frame construction.

Another object of the present invention is to provide in combination with the frame, a single connector which extends around the periphery of the frame and permits attachment of the sash of storm windows or screens having a mating single peripheral connector to the frame.

An additional object of the present invention is to provide an improved seal between a storm window sash and a window frame.

A further object of the present invention is to provide a frame for sliding closures with locking means to prevent opening of the closure.

These and other objects of the present invention will become apparent upon reading the following description thereof together with the accompanying drawings in which:

DETAILED DESCRIPTION OF THE PREFERRED EMBODIMENT

Figure 1:
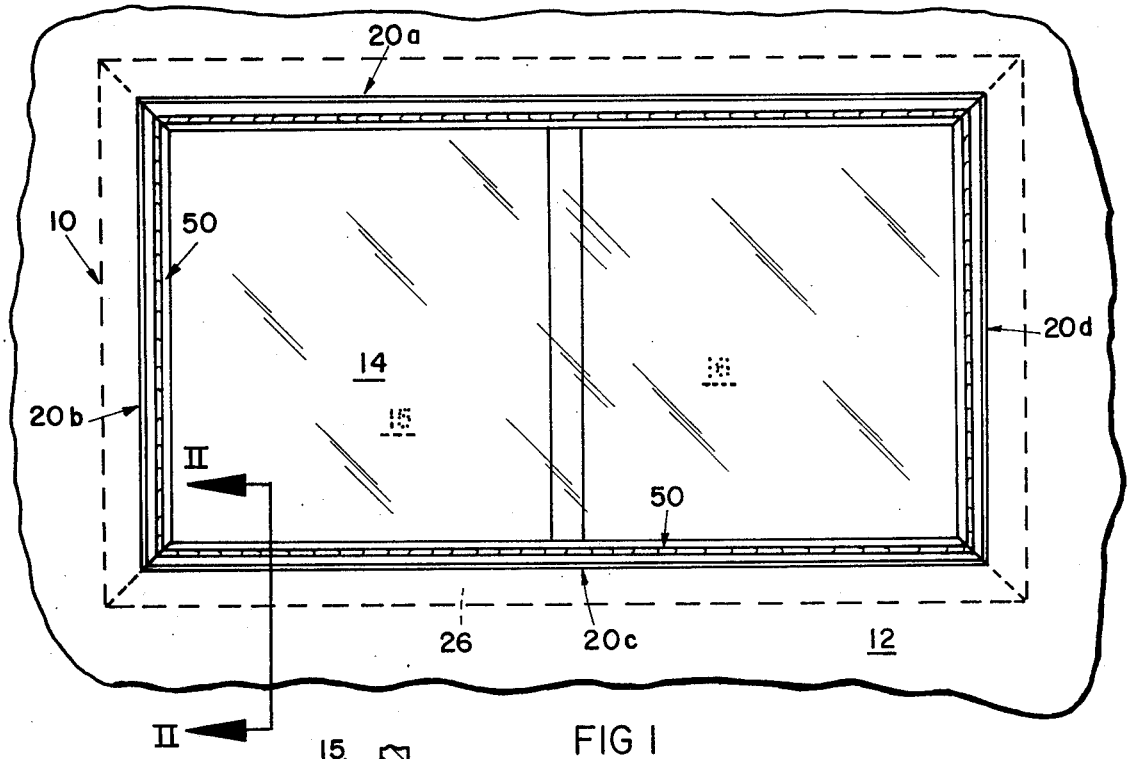
FIG. 1 is a front elevational view of a window unit including a storm window mounted thereto and constructed in accordance with the present invention.
Figure 2:
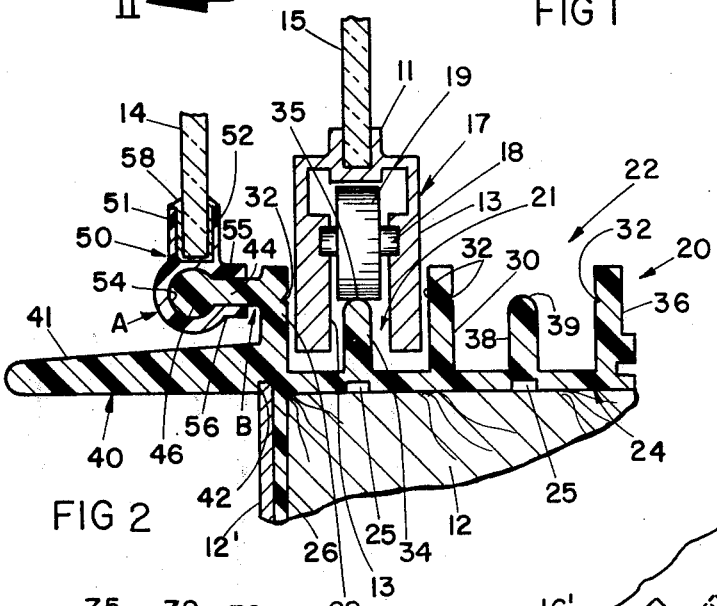
FIG. 2 is an enlarged fragmentary cross-sectional view of the window frame and sash taken along the section lines II—II in FIG. 1.

Referring now to FIGS. 1 and 2, there is shown a window unit 10 embodying the present invention. This unit is particularly well adapted for use in the mobile home industry although it also has general applications. The window unit includes an extruded rectangular frame 20 including members 20*a*–20*d* extending along the four peripheral edges of an opening formed in the wall 12 of the building in which the window unit is installed. The corners of the frame members are mitered and joined at a 45° angle as seen in FIG. 1. In the embodiment shown, the window unit includes an exterior window pane 14 forming a storm window surrounded and supported by a sash 50 constructed and attached to frame 20 as described below.

Behind the storm window 14 are first and second panes 15 and 16 (FIG. 1) of a sliding window. Each of the panes 15 and 16 is mounted in a sash 17 (FIG. 2) which includes a U-shaped window receiving notch 11 and a pair of spaced downwardly projecting legs 13 between which there is mounted an axle 18 supporting a roller wheel 19. A slide bar positioned between the legs could be employed in place of wheel 19. This construction permits the sliding windows 15 and 16 to move freely within channels or tracks 21 and 22 of the improved window frame. Typically, both panes will be movable for opening the window from either or both sides, although in some installations, only one of the panes, for example pane 15, will be fixed in place with remaining pane 16 movable.

Frame 20 includes a base member (FIG. 2) which has a bottom surface which rests on the edge of the opening formed in wall 12 of the building. A pair of spaced glue channels 25 are formed in and extend along the bottom of base 24 to permit adhesion of the base to the edge of the window opening. A downwardly projecting facing flange 26 is provided which fits over the outer edge of the wall 12, as seen in FIGS. 1 and 2, and is nailed to wall 12 under the siding 12'.

Channel 21 for window pane 15 is formed by an exterior upwardly extending vertical wall 28 and a middle upwardly extending vertical wall 30 spaced therefrom, both of which extend the length of the extruded frame member. Guide channel 22 is defined by wall 30 and inner upwardly extending vertical wall 36 spaced therefrom and extending along the frame member. Extending along the interior sides of walls 28 and 36 and on both sides of wall 30 approximately one-third of the distance from the top are triangular locking notches 32 provided for the purpose discussed below. Centered within and extending upwardly from the floor of channels 21 and 22 are upstanding glide shoulders 34 and 38, respectively, having rounded top surfaces 35 and 39 which are engaged by the rollers 19 of the window sashes 17 to provide a low friction support for the sliding windows. As seen in FIG. 2, the downwardly projecting legs 13 of the sash 17 extend into the channel 21 on either side of the glide shoulder to provide guided support for the sash. The sash for pane 16 is similarly constructed.

Frame 20 further includes an outwardly projecting lip 40 (FIG. 2) extending along the outer junction of base 24 and wall 28 to form an external drip cap for the window unit. The upper surface 41 of cap 40 is tapered to promote water runoff. Lip 40 is widened at its junction with wall 28 for added strength. A rectangular notch 42 is formed along the bottom of lip 40 adjacent flange 26 for receiving aluminum siding 12' which is frequently employed as a facing for wall 12 and the edge of which is secured and concealed within notch 42.

Extending outwardly from outer wall 28 spaced from cap 40 and near the top of wall 28 is an arm 44 terminating at its end remote from wall 28 in an enlarged rounded end 46 forming a male connector comprising a longitudinally extending circular cross section member for the mating coupler of the sash unit 50. Arm 44 and integral end 46 extend the length of the extruded frame members and around the peripheral edges of the window frame when assembled as shown in FIG. 1.

Frame 20 so formed is extruded of a polymeric material such as polyvinyl chloride (PVC) and the mitered corners are welded by conventional welding process to form the completed window frame for installation. The frame could likewise be made of aluminum or other suitable material. Having described the frame unit attached to the building, a description of the mating sash which accommodates either a storm window or screen is now described.

Sash 50 comprises an extruded resilient member including a U-shaped window receiving channel defined by a pair of spaced upstanding side walls 51 and 52 extending upwardly from an elongated circular socket 54. Socket 54 is circular and open along an edge from which extends a pair of lips 55 and 56 projecting from socket 54 orthogonally to the window receiving channel. The socket forms a female connector and is dimensioned to fit over the end 46 of the male connector of the frame 20 in ball and socket fashion to encompass end 46 over an arc of greater than 270° including the upper and lower portions of the circular end. Lips 55 and 56 engage opposite sides of arm 44 to further promote the coupling and sealing of sash 50 to frame 20. With such construction, a single intercoupling only is required.

Sash 50 is extruded of a polymeric material such as PVC which is resilient and deformable such that lips 55 and 56 and socket 54 open as the sash is snapped over the male connector of the frame. The sash unit, like the frame, is mitered at the corners and welded. The storm window pane 14 is fitted within the U-shaped pane receiving notch and sealed in place by means of a neoprene seal 58. Sash 50 extends around the peripheral edge of the window pane 14 to provide a sealed connection for window 14 to the window unit around its peripheral edge.

Installation of the storm window is achieved by pressing along the sash at point A (FIG. 2) at a convenient location along the periphery thereof and then sliding the applied pressure around the rim of the sash until the sash is securely snap-fitted around the entire periphery of the male connector of the window frame. For removal, a blunt curved tool is inserted under and behind the lip 56 at point B at a convenient location on the periphery of the window to pry away the coupling at one point after which the storm window can easily be removed. Thus, the storm window is easily installable and removable but resists undesired removal.

Figure 3:
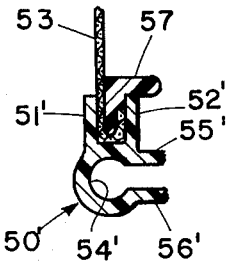
FIG. 3 is a fragmentary cross-sectional view of a sash for a screen.

FIG. 3 shows an alternative embodiment of the sash for accommodating a screen 53 which is held to a sash 50' identical in construction to sash 50 with corresponding part identified by the same reference numeral followed by a prime (') symbol. Screen 53 is held within sash 50' by means of an L-shaped screen bead 57 force-fitted to secure the screen within the screen receiving U-shaped notch. Bead 57 may also be extruded of a polymeric material such as PVC.

Figure 4:
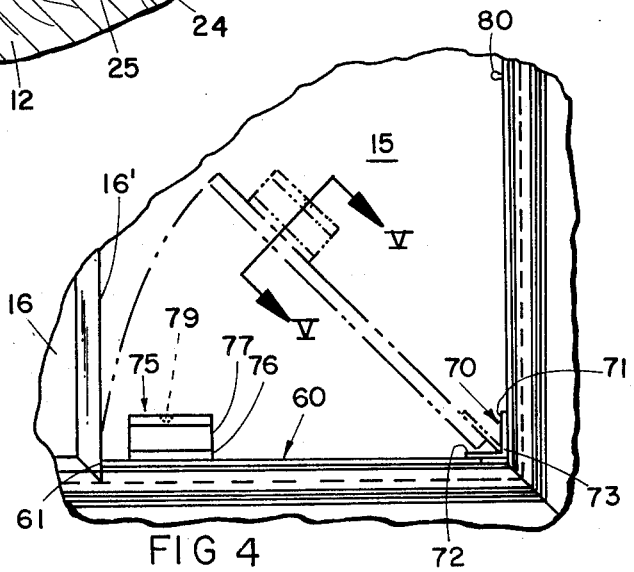
FIG. 4 is a rear elevational view of the window unit shown in FIG. 1 showing a locking bar coupled to the window unit.

In order to provide positive locking means preventing the opening of movable pane 16 of the window unit 10, a locking bar 60 is provided and can be integrally attached to the corner of frame 20 as seen in FIG. 4 or provided as a separate piece.

Bar 60 comprises an elongated member 62 extruded of resilient material (such as PVC) and having a tapered upper surface 64 to promote water runoff and downwardly projecting spaced legs 65 and 66 adjacent opposite edges thereof. Extending outwardly from the end of each of the legs is a triangular tab 67 shaped to correspond to the triangular notches 32 in the channels 21 and 22 of frame 20 (FIG. 2). The width of member 62 is selected such that the resilient and deformable legs 65 and 66 can be forced between the upstanding shoulders defining the guide channels in the frame such that the tabs lock in a snap-fitting fashion into the triangular apertures 32 extending along the side walls of the channel so formed.

In the embodiment of FIG. 4, bar 62 is attached at one end to the corner of frame 20 by means of a resilient polymeric hinge 70 of conventional and well-known construction. Hinge 70 is secured to the edge of the frame 20 at one end 71 and at its opposite end 72 is welded to bar 62. Between these legs forming the hinge, there is a necked down portion 73 permitting the pivoting of the bar 60 between a locked position shown in solid lines in FIG. 4 and an open position shown in phantom lines in FIG. 4.

Figure 5:
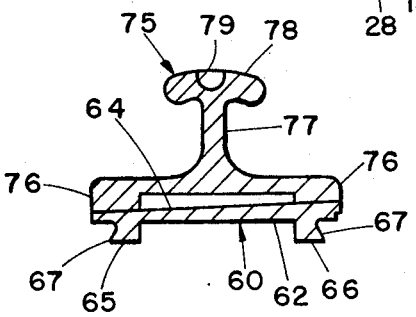
FIG. 5 is an enlarged cross-sectional view of the locking bar and handle therefor shown in FIG. 4 taken along the section lines V—V of FIG. 4.

The locking bar 60 may include a handle 75 including an upwardly extending central member 77 with a T-shaped handle 78 having a circular socket 79 formed therein. The handle is attached to bar 62 by means of a pair of downwardly depending legs 76 which are welded to the upper surface 64 of bar 62 as seen in FIG. 5. Socket 79 permits securing of the bar in an open position against the right side of the frame, as viewed in FIG. 4, by means of a circular ball 80 mounted to and extending from the right side of the frame as seen in FIG. 4.

Thus, the locking bar 60 can be held in an open position when desired or locked into a downward position whereupon the end 61 of bar 62 engages the frame 16' of window 16, as seen in FIG. 4, preventing the opening of the window and positively locking the window in a closed position. Since the edges of member 62 are held within the channel of the window by interlocking tabs and notches 67 and 32, respectively, the bar 62 need not be particularly thick to withstand compressive forces present when an attempt to open window 16 is made. Since the upper surface 64 of bar 62 is tapered, the extruded member can also be employed to cover the portion of channel 21 unused by fixed window 15 to provide drainage of water from the window unit when the storm window 14 is not employed.

Thus, it is seen that by providing the integral window frame and sash construction of the present invention, improved fastening means are achieved which provide a seal and fastener for the window, the frame of which includes means for locking sliding glass windows mounted within the frame. Such construction also has equal application to sliding patio door units where it is desirable to include, in addition to the conventional locking devices, the positive stop bar constructed according to this invention.

It will become apparent to those skilled in the art that various modifications to the present invention can be made without departing from the spirit or scope of the invention as defined by the appended claims.

The embodiments of the invention in which an exclusive property or privilege is claimed are defined as follows:

1. A window frame and sash adapted to be coupled to said frame comprising:

an integral frame member extruded of polyvinyl chloride including a floor and channel means extending upwardly therefrom for supporting a sliding window therein and including at least one exterior wall extending around the periphery of said frame and a mounting flange extending parallel to said exterior wall in an opposite direction;

an integral coupling means comprising a rod extending outwardly from said exterior wall and coupled to said exterior wall by a support member and extending substantially continuously around the periphery of said frame, wherein said frame member further includes a drip cap extending outwardly from said exterior wall intermediate said rod and said flange; and a window sash extruded of polyvinyl chloride for supporting one of a window or screen and including an elongated circular socket extending substantially continuously around the periphery of said sash and adapted to engage said rod associated with said frame and including segments engaging opposite sides of said support member of said rod whereby said socket grips said rod and engages at least 270° around said rod for sealably and removably attaching said sash to said frame.

2. The apparatus as defined in claim 1 and further including a locking bar pivotally mounted at one end to said frame and movable between a locking position within said channel such that an opposite end engages an edge of a sliding window in said channel to prevent movement thereof, and a nonlocking position remote from said channel to permit movement of said window in said channel.

3. A window assembly having a window frame including a first window mounted therein and a track defined by spaced walls of said frame for receiving a sliding window extending along a portion of said track and movable for providing an opening for the window assembly, said spaced walls defining said track including notches extending along said walls near the top thereof on facing surfaces of said walls, and a relatively thin locking bar including continuously extending resilient tab means extending along opposite sides of said bar for engaging said notches of said walls to releasably hold said bar in said track in a locking position, said locking bar hingedly fixed at one end to one of said window frame or said sliding window for movement between a locking position and a non-locking position, the free end of said locking bar engaging the other of said window frame or sliding window when in a locking position to prevent motion of said sliding window when in a closed position.

4. The apparatus as defined in claim 3 wherein an upper surface of said locking bar is sloped to promote drainage of water away from said window frame.

5. The apparatus as defined in claim 4 wherein said locking bar and tabs are extruded of polyvinyl chloride.

6. A window frame and sash adapted to be coupled to said frame comprising:

an integral frame member extruded of a resilient polymeric material including a floor and channel means extending upwardly therefrom for supporting a sliding window therein and including at least one exterior wall extending around the periphery of said frame and a mounting flange extending parallel to said exterior wall in an opposite direction;

an integral coupling means comprising a rod extending outwardly from said exterior wall and coupled to said exterior wall by a support member and extending substantially continuously around the periphery of said sash and adapted to engage said rod associated with said frame and including segments engaging opposite sides of said support member of said rod whereby said socket grips said rod and engages at least 270° around said rod for sealably and removably attaching said sash to said frame, wherein said frame member further includes a drip cap extending outwardly from said exterior wall intermediate said rod and said flange.

7. The apparatus as defined in claim 6 wherein said circular socket of said sash includes lips which engage opposite sides of said support member.

8. The apparatus as defined in claim 7 and further including a locking bar pivotally mounted at one end to said frame and movable between a locking position within said channel such that an opposite end engages an edge of a sliding window in said channel to prevent movement thereof, and a nonlocking position remote from said channel to permit movement of said window in said channel.

9. A window frame and sash adapted to be coupled to said frame comprising:

an integral frame member including a floor and channel means extending upwardly therefrom for supporting a sliding window therein and including at least one exterior wall extending around the periphery of said frame and a mounting flange extending parallel to said exterior wall in an opposite direction;

an integral coupling means comprising a rod extending outwardly and spaced from said exterior wall and coupled to said exterior wall by a support member extending around the periphery of said frame wherein said rod is integrally formed with said support member such that the surface of said rod includes portions extending on opposite sides of the junction of said rod and said support member and extending more than 270° around said rod; and a window sash for supporting one of a window or screen and including an elongated circular socket of resilient material extending around the periphery of said sash and adapted to engage said rod associated with said frame and including segments engaging opposite sides of said support member of said rod for engaging said rod around at least 270° for sealably and removably attaching said sash to said frame.

* * * * *